US006758289B2

(12) United States Patent
Kelley et al.

(10) Patent No.: US 6,758,289 B2
(45) Date of Patent: Jul. 6, 2004

(54) METHOD AND APPARATUS FOR HYDROCARBON SUBTERRANEAN RECOVERY

(75) Inventors: Wayne Leroy Kelley, Houston, TX (US); Andrew M. Ashby, Evergreen, CO (US); Robert Leslie Ewen, Houston, TX (US); Robert Harold Trent, Kaycee, WY (US)

(73) Assignee: Omega Oil Company, Calgary (CA)

( * ) Notice: Subject to any disclaimer, the term of this patent is extended or adjusted under 35 U.S.C. 154(b) by 0 days.

(21) Appl. No.: 09/858,917

(22) Filed: May 16, 2001

(65) Prior Publication Data

US 2002/0074122 A1 Jun. 20, 2002

Related U.S. Application Data

(60) Provisional application No. 60/204,793, filed on May 16, 2000.

(51) Int. Cl.[7] ..... E21B 7/04

(52) U.S. Cl. ..... 175/61; 175/79; 175/94; 166/77.3; 166/369

(58) Field of Search ..... 175/61, 62, 73–75, 175/78, 79, 94, 103, 162, 220; 166/77.3, 369

(56) References Cited

U.S. PATENT DOCUMENTS

| | | | | |
|---|---|---|---|---|
| 4,007,797 A | * | 2/1977 | Jeter | 175/26 |
| 4,020,901 A | | 5/1977 | Piso et al. | |
| 4,296,969 A | | 10/1981 | Willman | |
| 4,410,216 A | | 10/1983 | Allen | |
| 4,434,849 A | | 3/1984 | Allen | |
| 4,458,945 A | | 7/1984 | Ayler et al. | |
| 4,494,617 A | | 1/1985 | Snyder | |
| 4,577,703 A | * | 3/1986 | Cyriacy et al. | 175/79 |
| 4,640,353 A | * | 2/1987 | Schuh | 166/248 |
| 4,852,666 A | * | 8/1989 | Brunet et al. | 175/61 |
| 5,311,952 A | * | 5/1994 | Eddison et al. | 175/61 |
| 5,360,075 A | | 11/1994 | Gray | |
| 5,425,429 A | | 6/1995 | Thompson | |
| 5,485,889 A | | 1/1996 | Gray | |
| 5,573,343 A | | 11/1996 | Gray | |
| RE36,556 E | | 2/2000 | Smith et al. | |
| 6,047,784 A | * | 4/2000 | Dorel | 175/61 |
| 6,050,351 A | | 4/2000 | Eckenfels et al. | |

* cited by examiner

*Primary Examiner*—Zakiya Walker
(74) *Attorney, Agent, or Firm*—Christensen O'Connor Johnson Kindness PLLC

(57) ABSTRACT

Enhanced horizontal drilling systems and methods encompass the production of crude oil from wells drilled from a subterranean production facility. This approach has the location of the well head below the oil reservoir to improve flow rate and recovery due to the consistent voiding of fluids by gravity flow within the well bore to the well head allowing well bore production pressure to achieve extremely low fluid pressure or even a vacuum of up to 15 PSI. This method increases oil recovery rate and factor, and lowers production costs. The present method is production of shallow crude oil by way of long horizontal or near horizontal boreholes drilled and serviced from a subsurface workroom. The subsurface workroom serves as both the drilling platform and the place to which production is centrally accumulated from the wells. Oil is collected in a central facility and is then lifted to the surface utilizing pumps. The method allows for maximum control and range of borehole pressure, elimination of costly down-hole pumps and the introduction of production enhancing devices within the production stream such as in-hole injection of heated diluent.

23 Claims, 13 Drawing Sheets

FIG. 5A
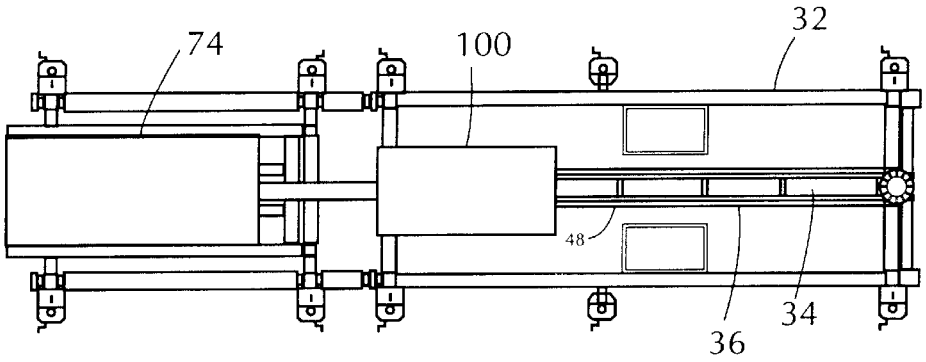
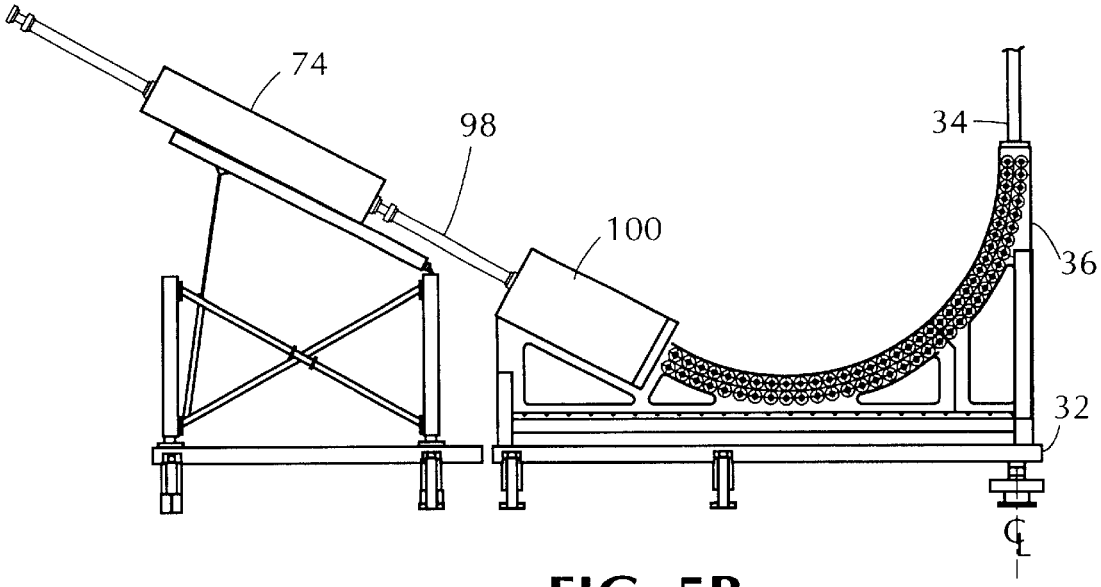
FIG. 5B

METHOD AND APPARATUS FOR HYDROCARBON SUBTERRANEAN RECOVERY

This application claims the benefit of U.S. Patent Application Serial No. 60/204,793 filed May 16, 2000 and entitled METHOD AND APPARATUS FOR HYDROCARBON SUB-SURFACE RECOVERY.

BACKGROUND OF THE INVENTION

This invention relates to well arrangements for subsurface fluid hydrocarbon production.

Techniques for hydrocarbon production are well known in the prior art, including conventional drilling techniques. The reference to "hydrocarbon" herein is to fluid and gaseous hydrocarbons, such as crude oil and natural gas. However, under certain circumstances, conventional drilling techniques are not efficient to tap into a reserve of hydrocarbons. To tap into such reserves, "oil mining" techniques have been developed, wherein a vertical or horizontal shaft is bored directly into, or in proximity to, the reserve. A drill room is excavated in the shaft, and horizontal wells, which may be slightly inclined, are bored from the drill room into the reserve. The wells allow for drainage of fluids into a common location, where the oil is transported by pump, or other device, to the grade surface.

The typical porous formation to which this method and device relate is a porous oil and gas bearing strata entrapped underground between a fluid impermeable cap rock above and a fluid impermeable stratum below. The typical desired fluid is hydrocarbon. The present invention relates to a method and a system which solves or avoids problems associated with prior art methods and systems used to recover desired hydrocarbons, such as oil or gas, from oil and gas bearing strata, which prior art is characterized by tunneling within or below the porous formation and drilling into the sands so that the desired fluid drains by the force of gravity into collection pits located on the floor of the tunnel.

Prior art methods and systems for using mine shafts or tunnels with oil drain pits for collecting oil drained form oil sands by the force of gravity have typically been called "oil-mining" systems or methods. In one early method, tunnels were driven horizontally through the impermeable cap rock above the oil bearing sand and square pits were dug vertically through the tunnel floor to the oil bearing sands a few feet below. The oil drained into these pits and was lifted periodically by a pneumatic device into a pipeline extending to surface tanks. This system was used in the Pechelbronn field near Hanover, Germany and is disclosed in G. S. RICE, U.S. BUREAU OF MINES.

Another variation of this method is known as the Ranney oil-mining system and is disclosed in L. C. UREN, PETROLEUM PRODUCTION ENGINEERING: OIL FIELD EXPLOITATION, 3d Ed. McGRAW-HILL (1953). In this system mine galleries or tunnels are driven in impermeable strata above or below the porous formation of oil bearing sand and holes are drilled into the porous formation at short intervals along these galleries. Fluid is withdrawn through pipes sealed into the drilled holes and is pumped to the surface through a system of drain pipes in the galleries.

Another method which has been proposed for mining oil from partially drained oil bearing sands involves drilling a vertical mine shaft through the porous formation and drilling long slanting holes radially in all directions from the shaft bottom into the oil sands. The oil was to drain from the sand through the radial slant holes into a pit or sump at the bottom of the shaft and was to be pumped to the surface.

There are problems associated with these prior art oil-mining systems. For example, where high pressure gases may be present in the porous formation the prior art methods may be ineffective because either the gas will escape directly into the tunnels, galleries, or shafts or the gas will force itself directly into the collection pipe system, thereby leaving the liquid unrecovered in the porous formation.

As can be readily appreciated, the recovery of hydrocarbon using prior art techniques is a function of many factors, including the permeability of the strata in which the hydrocarbon is located (typically sand), the multi-phase presence of other fluids (e.g., water, brine), the viscosity of the hydrocarbon, and the pressures within the well bore and external to the reserve. The use of an insufficient number of wells will not maximally recover hydrocarbon from the reserve, whereas, an excessive number of wells may not be economical.

SUMMARY OF THE INVENTION

Enhanced horizontal drilling systems and methods encompass the production of crude oil from wells drilled from a subterranean production facility. This approach has the location of the well head below the oil reservoir to improve flow rate and recovery due to the consistent voiding of fluids by gravity flow within the well bore to the well head allowing well bore production pressure to achieve extremely low fluid pressure or even a vacuum of up to 15 PSI. This method increases oil recovery rate and factor, and lowers production costs.

The present method is production of shallow crude oil by way of long horizontal or near horizontal boreholes drilled and serviced from a subsurface workroom. The subsurface workroom serves as both the drilling platform and the place to which production is centrally accumulated from the wells. Oil is collected in a central facility and is then lifted to the surface utilizing pumps. The method allows for maximum control and range of borehole pressure, elimination of costly down-hole pumps and the introduction of production enhancing devices within the production stream such as in-hole injection of heated diluent.

When utilized in many low energy shallow oil fields the subject production method is projected to lower per barrel production costs, accelerate rates of oil recovery and increase total economic recovery when compared to other conventional production methods inclusive of horizontal and near horizontal wells. These cost savings are attributable to generally accepted engineering concepts that profess that oil production is subject to the following factors:

- There is a direct proportional relationship between the amount of borehole surface area within the productive portion of the reservoir and the amount of fluid or gas produced.
- Fluid and/or gas migration (flow) within the reservoir to the borehole is a direct result of the reservoir pressure exceeding the borehole pressure (differential pressure).
- Fluid and/or gas migration within the reservoir to the borehole increases as differential pressure increases and declines as differential pressure declines.
- As migration distances increase total economic oil recovery decreases.

Any production method that reduces the cost of the well bore surface area within the productive portion of the reservoir is desirable because the more borehole surface area within the production area the greater the recovery factor. Additionally any method that reduces migration distance to the borehole is desirable. The subject method increases borehole surface area and reduces migration distance within a given production area. The increased borehole surface area allows higher recovery rates and optimizes differential pressure. When compared with conventional horizontal drilling methods the present method may save up to 60% of the combined capital and operations cost to produce a like amount of oil or gas for a like period of time. However, the subject method also may increase the recovery factor by up to 100% resulting in a dramatic increase in resource efficiency.

The potential savings offered by the method result from the following factors:

- The borehole is located almost entirely within the productive portion of the reservoir.
- The borehole is all drilled from a central location eliminating the cost of replicated support apparatus and the cost to break down, move and erect the drill rig. Cost is further reduced by the ability to use inexpensive proven drilling technology.
- Conventional boreholes are not produced in a static environment. As reservoir pressures approach zero the well has to be more frequently evacuated because the fluid column within the borehole more quickly reaches equilibrium with the reservoir pressure; hence flow stops. Because the well bore is drained to a central collection point the method allows for static production conditions down to 15 PSI vacuum pressure hence total economic recovery is increased.
- The production geometry reduces the migration distance; hence total economic recovery is increased.
- Consolidation of surface facilities further reduces operating expenses.
- environmental savings due to improved monitoring and centralization of production facilities making discovery and remediation of discharge events more effective.
- Conventional vertical and horizontal wells require down-hole pumps to lift the oil when fluid column from the reservoir to the surface exceeds reservoir pressure. (This is the case at some point in the life of all wells.) The maintenance of the down-hole pumps is expensive. Frequent pulling operations utilizing work-over rigs to retrieve and replace the pumps are required to keep the wells producing. These pulling operations are quite expensive and contribute significantly to operating costs and increases down-time and lost revenue. The subject method requires no down-hole pumps or other down-hole servicing. All pumping is done through large reliable and efficient pumps centrally located in the subsurface drill room that are easily serviced.

The following forecast environmental benefits are derived from the production methods:

1. Reduction of surface disturbance by 90%+.
2. Consolidation of production facilities and reduction of surface communication.
3. Reduction in reclamation effort.
4. Elimination of cross-communication of fluids within the well bore as wells cross various formations.
5. Dramatic increase in recovery per acre results in improved trade-off when considering surface disturbance.
6. Central drilling location provides improved economics of scale for more effective treatment of drilling wastes and by-products.
7. Central location of all facilities makes twenty-four hour monitoring of entire production facility economically possible. Non-stop monitoring allows for quicker discoveries of leaks, less environmental damage and lower cost environmental remediation.

BRIEF DESCRIPTION OF THE DRAWINGS

FIG. 5*a* is a plan view of the turntable;

FIG. 5*b* is a section view of the turntable;

DETAILED DESCRIPTION OF THE PREFERRED EMBODIMENTS

Figure 1:
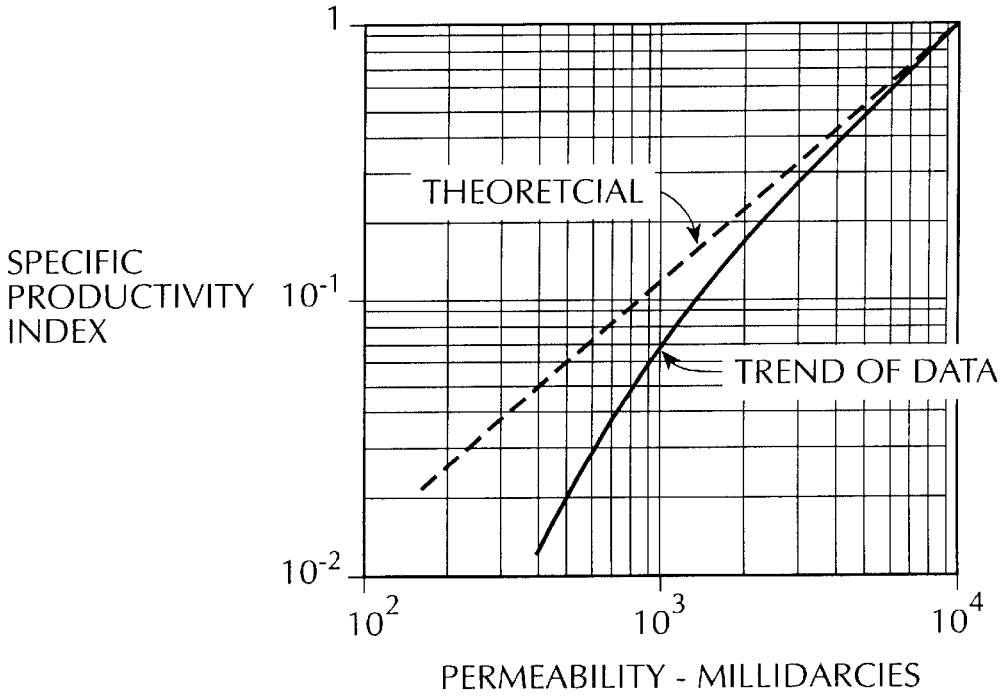
FIG. 1 is a graph of specific productivity indices plotted as a function of reservoir permeability.

The present invention includes a method of arranging wells for sub-surface, hydrocarbon production, and an arrangement formed in accordance with the method. Reference herein to "sub-surface" production techniques includes the oil mining techniques discussed above, as well as other techniques, including the drilling devices specific to sub-surface production. To this end, the inventors herein have developed a maximum well pattern spacing (MWPS) coefficient for determining an appropriate well spacing (WS) for wells in a given arrangement. Using typical values associated with conventional wells, it is preferred that a maximum well spacing of 24.6 acres be used in arranging wells.

Relying on the WS coefficient, an exemplary arrangement of wells has been created, wherein wells of different lengths are bored from a vertical shaft. Preferably, the wells are of three different lengths, with wells of each length being evenly spaced about the vertical shaft. It is also preferred that the furthest extent of each well be perforated over a predetermined length to achieve hydrocarbon recovery. The perforated sections, however, are spaced from the vertical shaft.

Darcy's law is a common equation used throughout the oil industry. This law is a quantitative expression that describes the flow of fluids through a reserve. The general formulation of his law is given in linear coordinates by equation 1.

$$v=-(k\ dp)/(\mu dl) \qquad \text{Equation 1}$$

where v—velocity of flow $\mu$—viscosity of the fluid k—permeability of the material dp/dl—pressure gradient In current reservoir engineering practice, Darcy's law has been extended for the simultaneous flow of more than a single liquid. Equation 2 represents steady-state radial flow from an external boundary to a well bore. Other geometry could be demonstrated, but for purpose of this description radial flow is provided.

$$q_i=7.07k_{ri}k_a h(P_e-P_w)/(\mu_i ln(r_e/r_w)) \quad \text{Equation 2}$$

where $q_i$—flow rate of liquid phase i (i can be o for oil, or w for water), bbl/day $k_{ri}$—relative permeability of phase i, dimensionless $k_a$—absolute permeability of rock, darcies h—thickness of the pay zone, feet $P_e$—external boundary pressure, psia $P_W$—well bore pressure, psia $\mu_i$—viscosity of phase i (i can be o for oil, or w for water), centipoises $r_e$—radius of the external boundary, feet $r_w$—radius of the well bore, feet.

Equation 3 describes the case for the radial flow of oil in a reserve under steady-state conditions.

$$q_o=7.07k_o h(P_e-P_w)/(\mu n(r_o/r_w)) \quad \text{Equation 3}$$

where o—denotes the oil phase $k_o$—$K_{10}$, $K_a$ darcies, $K_{ro}$ is a relative value for oil and $K_a$ is an absolute value.

According to the Petroleum Production Handbook, the ability of a well to produce is usually determined by the use of a "productivity index." The use of the productivity index was first mentioned around 1930.

Relying on equation 3, the productivity index (PI) is defined by equation 4. As stated by the Petroleum Production Handbook, equation 4 indicates that the productivity index should be a function of the formation characteristics, fluid characteristics, and system characteristics of a reserve.

$$PI=q_o/\Delta P7.07k_a h/\mu_o 1r_o/r_w \quad \text{Equation 4}$$

where, $\Delta P=P_3-P_w$.

As shown in FIG. 1, productivity indexes were employed to determine reserve permeability in the prior art. FIG. 1 shows that actual data trends differed from theoretical analysis. The results however are sufficiently accurate for engineering evaluation.

The variables of equation 3 can be rearranged in the form of equation 5, $$q_o\mu_o/[7.07k_o h(P_e-P_w)]=/(1n(r_e/r_w)) \quad \text{Equation 5}$$

A well spacing productivity index (WSPI) can be defined from equation 5 as shown by equation 6.

$$WSPI=1/(1n(r_e r_w)) \quad \text{Equation 6}$$

Since $r_e$ is a function of the reserve flow boundary and $r_w$ is essentially a constant for a fixed well size, equation 6 describes a well spacing coefficient based on a radius of drainage.

Using equation 6, any WSPI can be calculated for a given $r_e$.

Well spacing (WS) can be determined by equation 7 using the radius of drainage of equation 6.

$$WS=\pi r_e^2/43560 \quad \text{Equation 7}$$

where,

WS—well spacing, acres $\pi$—3.1241593 (a constant)

$r_e$—radius of the external flow boundary.

Also, cumulative oil recovery is a function of oil production rate as given by equation 8, $$Np-f(q_o) \quad \text{Equation 8}$$

where, $N_p$—cumulative oil production, bbs $q_0$-oil production rate, bbl/day.

Since cumulative oil recovery is a function of oil production, then cumulative oil recovery is a function of the well spacing productivity index (WSPI) as defined by equation 9.

$$Np=f(WSPI) \quad \text{Equation 9}$$

Figure 2:
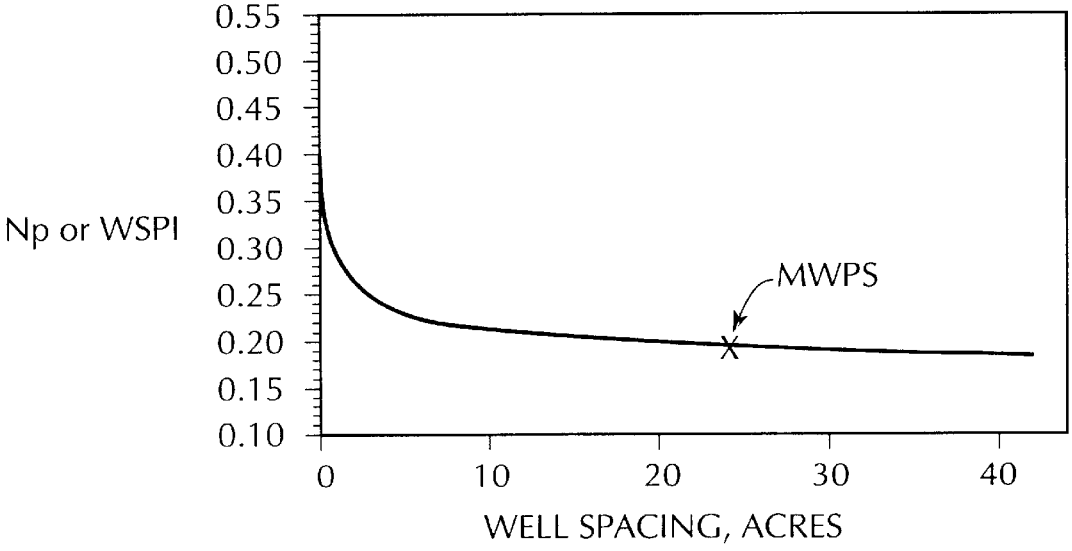
FIG. 2 is a graph of oil recovery versus well spacing.

The graphical results for determining well spacing as a function of the area of oil produced is given in FIG. 2. This figure shows that as the well spacing is reduced to a very small value, the amount of oil produced from that given area increases.

FIG. 2 also shows that as WSPI approaches a minimum, the well spacing approaches a maximum. For purposes herein, a maximum well spacing is defined as where a cumulative oil recovery ($N_p$) increase becomes insignificant with a decrease of well spacing. An insignificant increase in oil recovery is preferably defined as less than two percent with a change in well spacing of 3 acres. With these parameters, this provides a maximum well spacing of 24.6 acres. This value is defined as the maximum well pattern spacing (MWPS) which is theoretically independent of a reserve's physical properties.

In viewing FIG. 2, a well spacing greater than MWPS does not provide any beneficial results as a function of oil recovery. Also if the well spacing is reduced from MWPS, the cumulative production for a given area may be further increased. However, the increase in production does not economically justify the greater number of wells required for production i.e. the production of each well is not economically increased.

Figure 3:
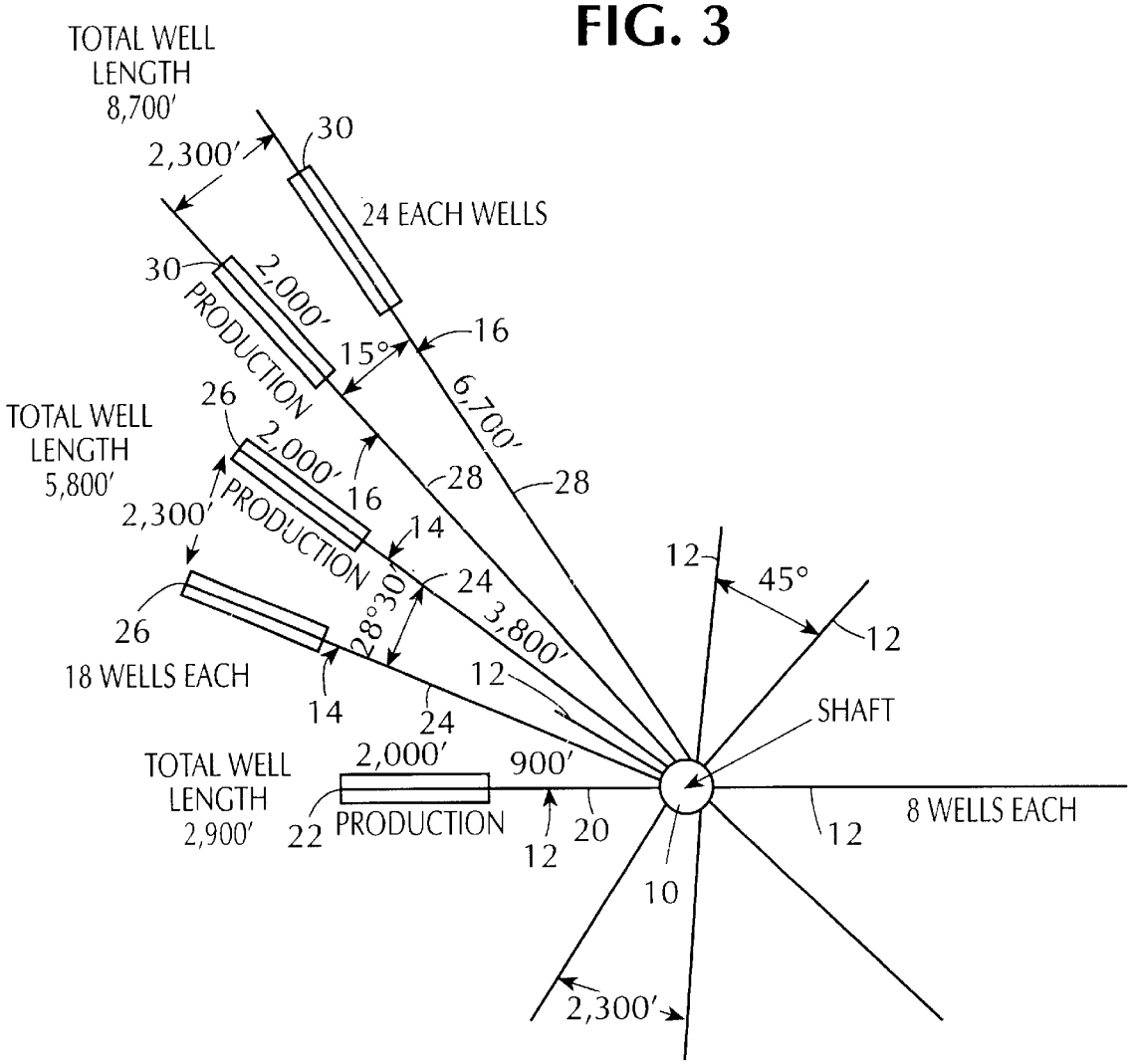
FIG. 3 is a schematic of a partial layout of a well arrangement.

Relying on a maximum well spacing of 24.6 acres, the inventors herein have prepared an exemplary arrangement of oil wells. By way of non-limiting example, referring to FIGS. 3 and 4, a well arrangement for sub-surface hydrocarbon production is shown. The arrangement is generally centered about a vertical shaft 10 which is formed through a grade surface. The particular angle of the shaft 10 relative to the grade surface is not critical to the practice of the invention. Generally, in a common plane, wells of three lengths, 12, 14, and 16, are bored to radiate from the shaft 10, wherein the wells 12, 14, 16 can be inclined.

The wells 12 are of the shortest radius. In the depicted arrangement, each of the wells 12 is formed with a 900' fluid conveying section 20, which may be for example, a 3½ inch diameter pipe. Extending from each of the fluid conveying sections 20 is a production section 22, which is preferably a 2000' tubular section that is perforated for hydrocarbon recovery. As such, the wells 12 each have a total length of 2,900'. It is also preferred that eight of the wells 12 be provided, and the wells 12 be evenly spaced about the shaft 10, with angular separations of 45 degrees.

The wells 14 and 16 are formed in similar fashion, but with greater radii. The wells 14 each have a fluid conveying section 24 which is 3,800' in length, and a production section 26 extending therefrom also of 2,000'. Thus, each of the wells 14 has a total well length of 5,800'. Sixteen of the wells 14 are preferably provided and preferably disposed to be evenly spaced about the vertical shaft 10 with angular separations of 22.5° (shown in FIG. 3 as 22° 30').

The wells 16 are each formed with a fluid conveying section 28 that is 6,700' long, and a production section 30 of 2,000' extending form the end thereof. The total length of each of the wells 16 is 8,700'. It is preferred that twenty-four of the wells 16 be provided, and that the wells 16 be evenly spaced about the vertical shaft 10 at 18° intervals.

It is preferred that the production sections 22, 26, 30 be spaced from the vertical shaft 10.

Figure 4:
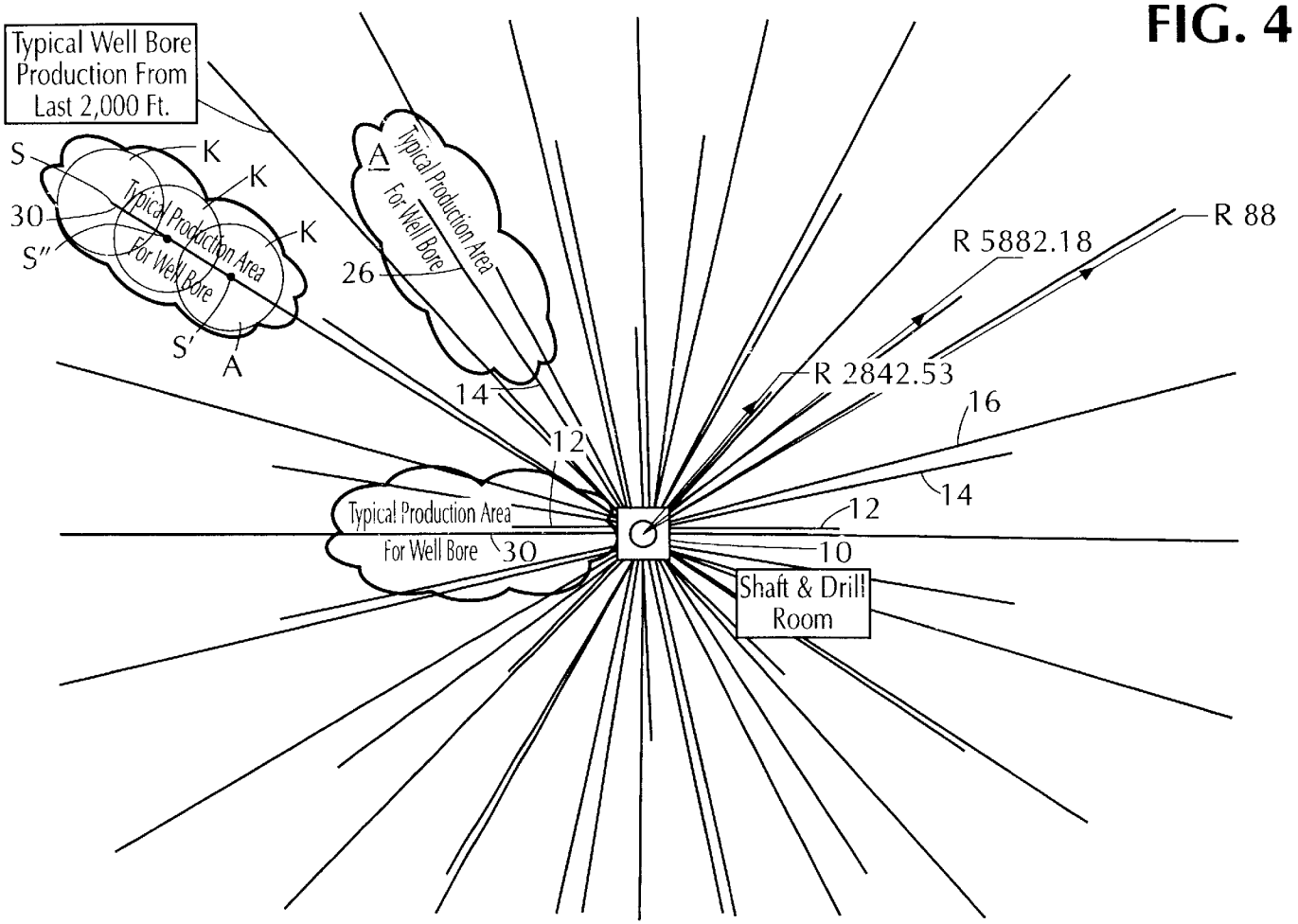
FIG. 4 is a schematic of a complete well arrangement.

FIG. 4 depicts a full layout of the wells 12, 14, 16 about the vertical shaft 10 in the disclosed arrangement. As shown schematically in FIG. 4, each of the respective production sections 22, 26, 30 of the wells 12, 14, 16 is associated with a production area A. As can be readily appreciated, the production areas A for the various wells 12, 14, 16 will overlap to certain degrees. The MWPS calculated above of 24.6 acres, is applied, to the arrangement of FIGS. 3 and 4, wherein at each point along the production section 22, 26, 30 of each respective well 12, 14, 16, the well spacing is 24.6 acres. For example, at point S, the well spacing of 24.6 acres defines an area K of 24.6 acres in which no production section of a neighboring well is located. Likewise, the point $S^{\pi}$ also lies in an area K of 24.6 acres in which no production sections of adjacent wells are located. However, point $S^{m}$ lies in an area K of 24.6 acres which overlaps the areas K of points S and $S^{m}$. Overlapping areas K of points S, $S^{m}$, $S^{\pi}$ on the same production section are acceptable. Overlap of the areas K of different production sections are not acceptable.

The well arrangement described herein, as well as the calculation technique disclosed above, result in a planar arrangement that does not take into consideration the depth of a reserve.

In other words, referring to FIG. 4, the depth of a reserve, as measured in a direction perpendicular to the plane of FIG. 4, may be 100' or 5,000'. The actual depth does not affect the arrangement. It may be that under certain circumstances, where hydrocarbons are being produced from a deep reserve, that multiple tiers of wells can be used formed at different depths of the vertical shaft.

The present invention also encompasses coiled tubing technology to drill and case the boreholes for the projects. Heretofore, drilling from subterranean drill stations has been accomplished with screw pipe. Screw pipe drilling may be problematic in pressure zones greater than the extremely low PSI environment contemplated. Well control and safety concerns make coiled tubing a preferable alternative to screw pipe drilling. Furthermore, the inherent high production rates of coiled tubing operations are well suited to a site where hundreds of thousands of feet of slim-hole lateral drilling may be drilled from a single location. Low-pressure shallow reservoirs are often best drilled in an underbalanced condition, a job best suited for coiled tubing. The combined economics and technical advantages of coiled tubing make this technique the preferred method of borehole development. Although coiled tubing day rates are comparatively high, the high production rate from a single set up promise considerable savings in completion cost.

Figure 10:
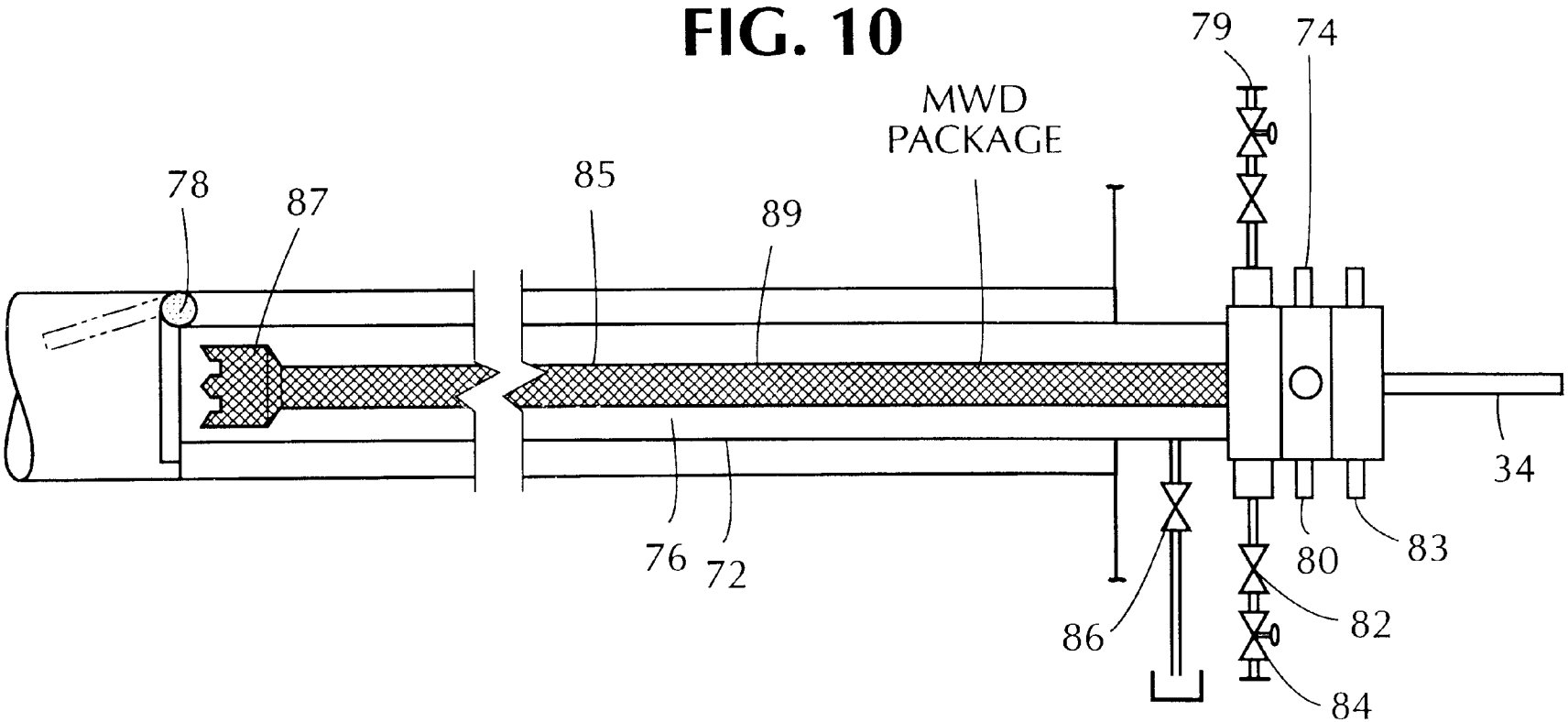
FIG. 10 is a schematic of the BHA deployment lubricator.
Figure 11:
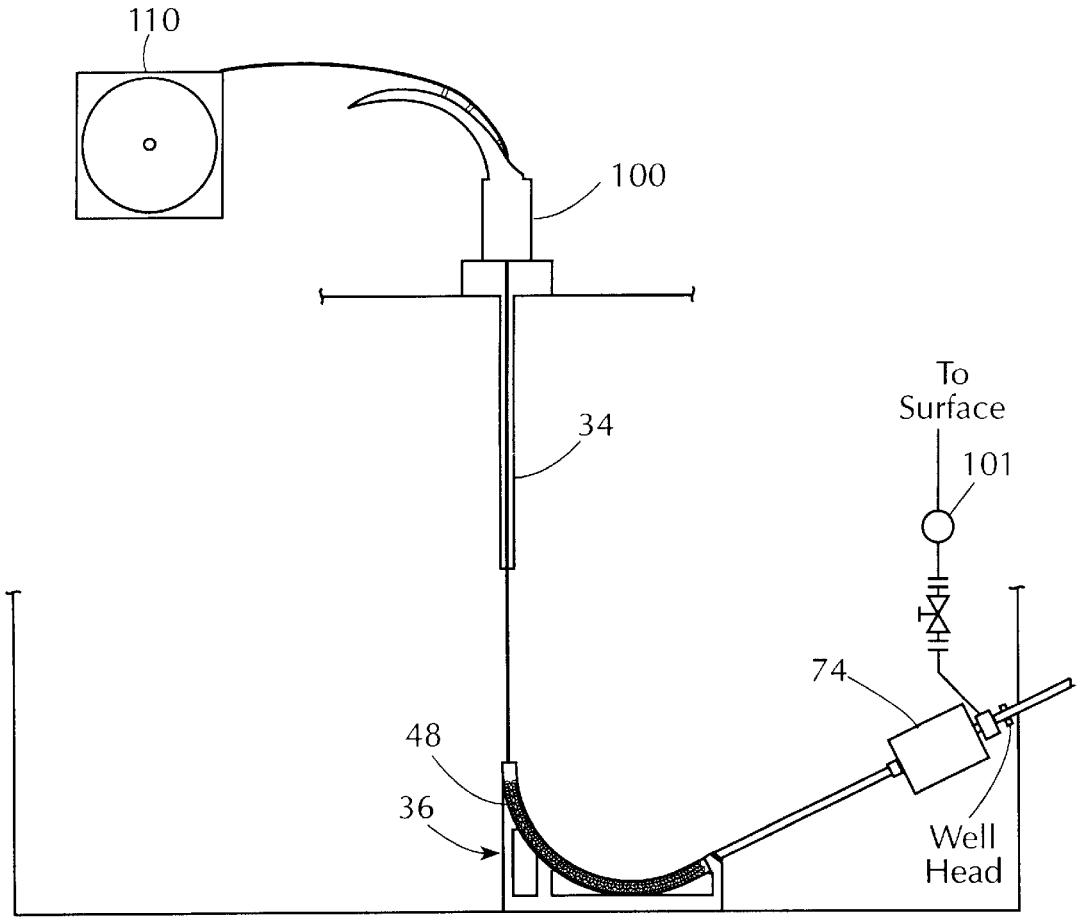
FIG. 11 is a schematic of the fluid return apparatus.
Figure 12:
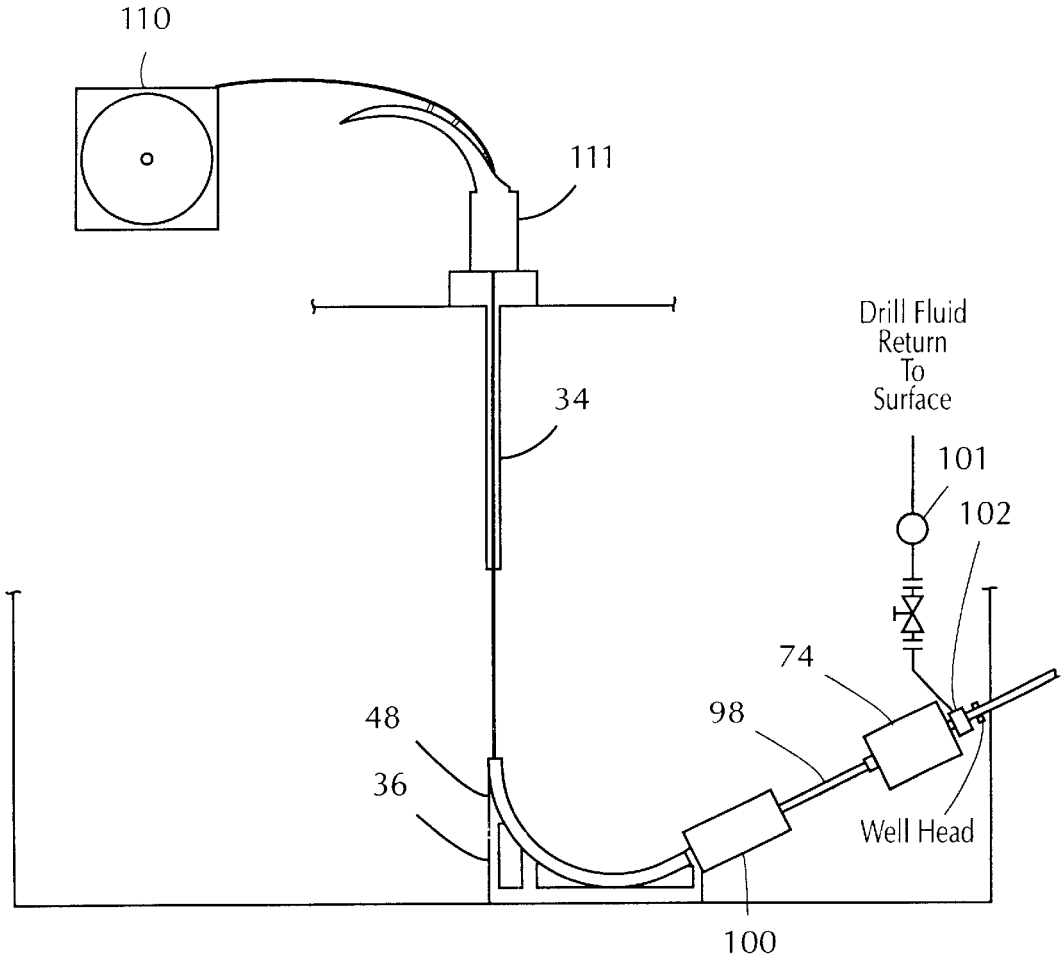
FIG. 12 is a schematic of another embodiment of the fluid return apparatus.
Figure 13A:
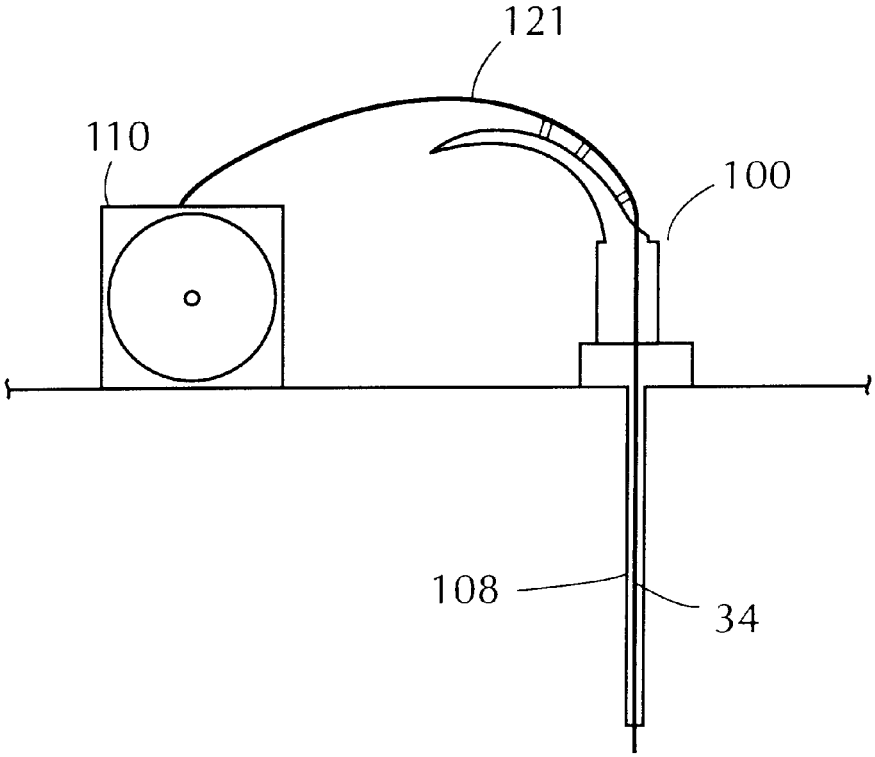
FIG. 13*a* is a schematic of the coiled tubing raceway.
Figure 13B:
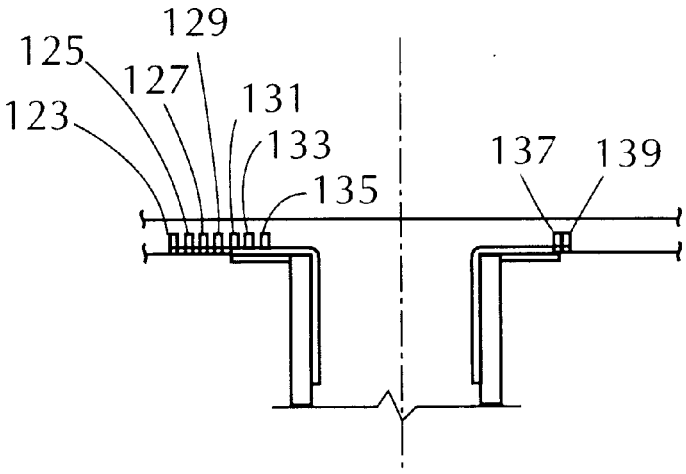
FIG. 13*b* is a detail view of the shaft of FIG. 13*a*.
Figure 14:
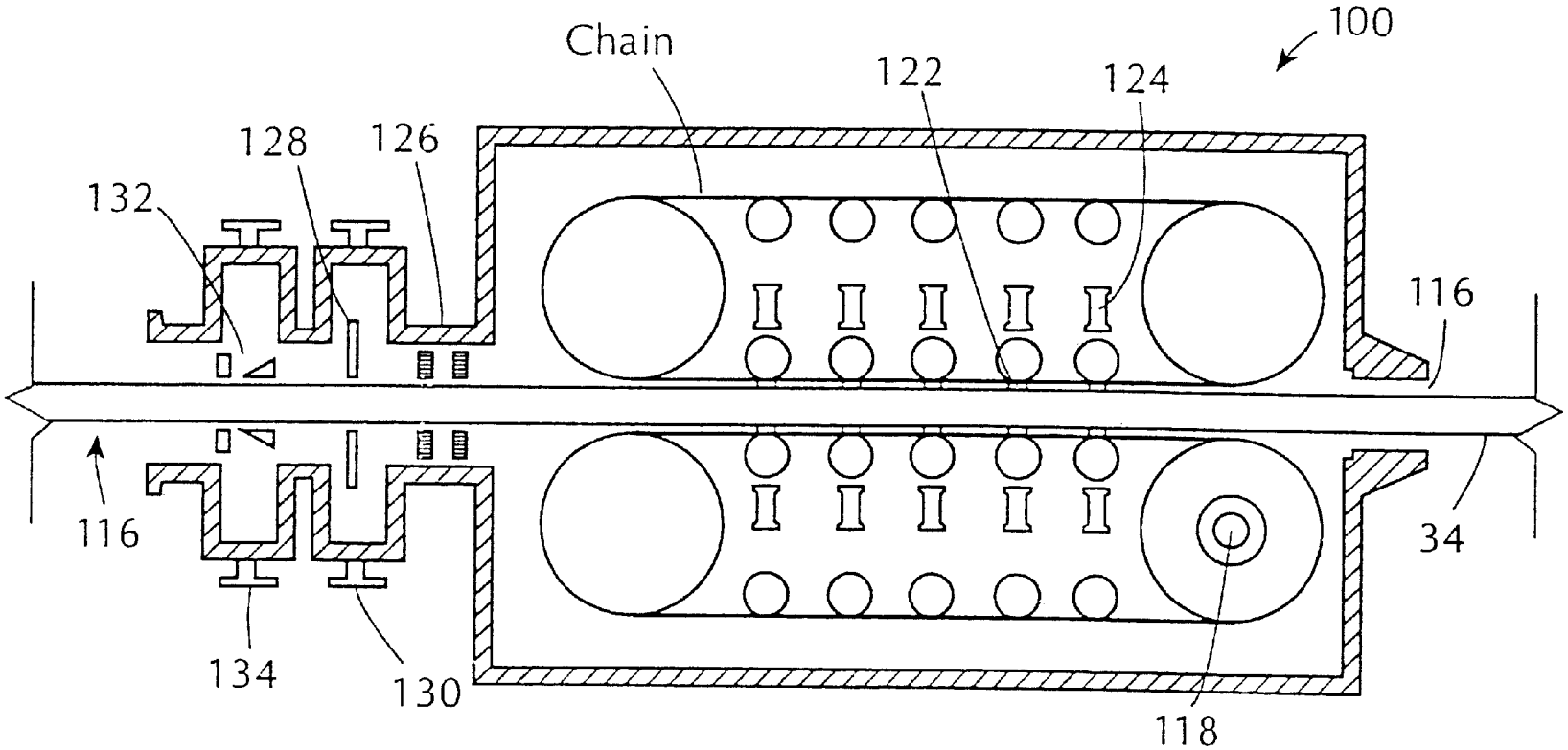
FIG. 14 is an exposed view of the primary traction device.

Coiled tubing drilling using the present invention includes several specialized devices, including turntable, thrust-block, heated annulus, deployment lubricator, fluid return system, coiled tubing raceway, primary traction device, and service window, as shown in FIGS. 5*a*–14. Referring to FIGS. 5*a*–6*b*, turntable 32 orients a coiled tubing drill string 34 on the horizontal azimuth. The drill string 34 is converted from a true vertical alignment to a horizontal or near horizontal alignment through a thrust block 36. The thrust block 36 attaches to the turntable 32 using conventional fasteners; proposed bolt-hole alignment is detailed in FIGS. 5*a*–5*b*. The turntable 32 aligns the drill string 34 as it exits the thrust block 36 to the desired location on the compass rose (azimuth) by rotation of the attached thrust block 36. The pins operate on a simple shear concept. The thrust-block 36 allows for coiled tubing drilling from a single surface location in a near infinite number of horizontal directions by utilizing a sub-surface horizontal orientation device. Turntable 32 also includes collar 38 (FIGS. 6*a* and 6*b*) to allow 360° rotation within the drill room. Blow out preventer (BOP) 74, described in relation to FIG. 10 and primary injector 100, described in conjunction with FIGS. 12 and 14, are arrayed coaxially with drill string 34, on turntable 32. BOP 74 allows deployment of bottom hole assembly (BHA) into a live well in the inverted or horizontal positions. Primary injector 100 is located on turntable 32 in a subterranean drill room and provides force on the bit by means of coiled tubing unit 110 with a steerable drilling assembly.

Figure 6A:
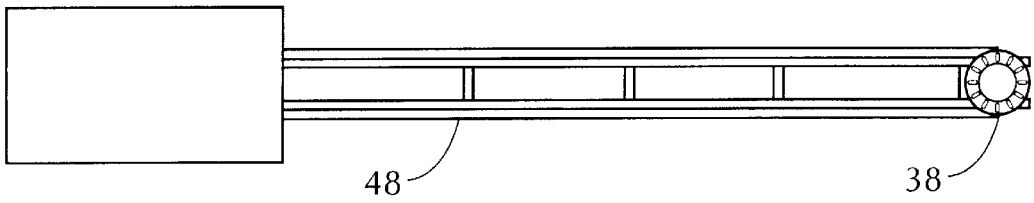
FIG. 6*a* is a plan view of the thrust-block.
Figure 6B:
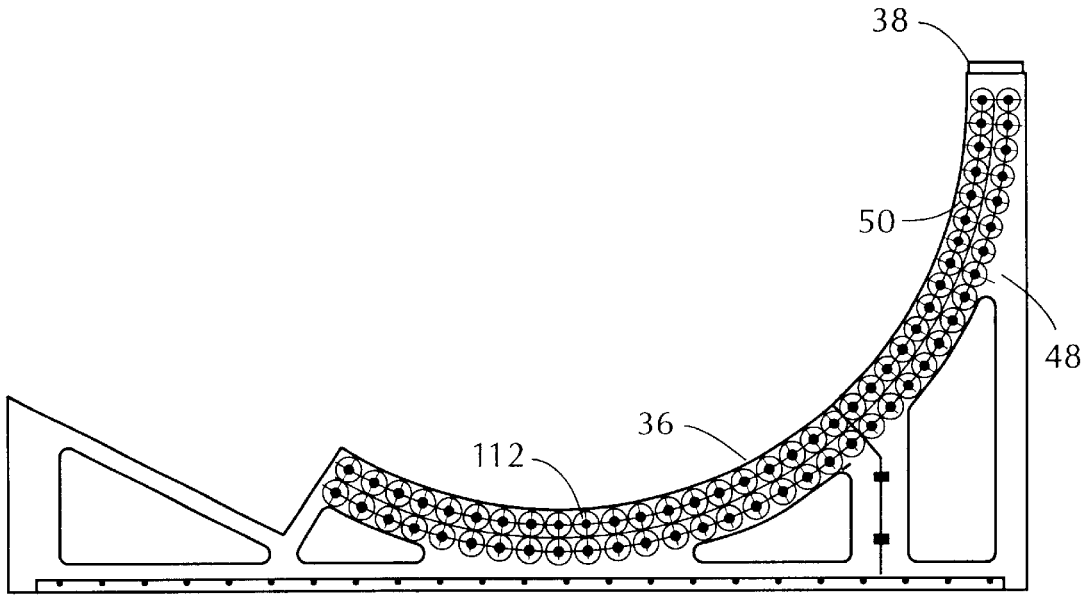
FIG. 6*b* is a section view of the thrust-block.

Referring to FIGS. 6*a*–6*b*, thrust-block 36 is intended to alter a coiled tubing drill string 34 from a vertical to horizontal or near horizontal alignment within a short turn radius, 20 feet or less, by the use of a mechanical device. The mechanical device is intended to take advantage of the inherent elasticity (temporary deformation) and plasticity (permanent deformation) of coiled tubing drill string 34 that permits bending of the coiled tubing drill string 34 (pipe) in a short radius without structural degradation. The thrust-block 36 is intended to alter the drill string 34 alignment from vertical to horizontal or near horizontal in a radius of as little as ten feet and as great as thirty feet. The alignment change is achieved by the coiled tubing drill string 34 being fed and or pulled through a curved or arcuate portion of thrust-block 36 having (raceway) 48 friction reduction devices 50 that may consist of rollers, bushings and or collars 112 coated or consisting of low friction materials such as nylon and teflon. The compressive forces on the coiled drill string 34 are great enough to bend the drill string 34 without structural degradation within the thrust-block 36. The thrust-block 36 is capable of withstanding lateral forces that may develop as a result of moment-arm. The thrust-block 36 is unique in that it bends coiled tubing to near minimum radius in a below surface location. This ability allows for remotely operated coiled tubing drilling and service operations to be conducted from the surface through a subterranean drill station and horizontal or near horizontal well bores.

Figure 7A:
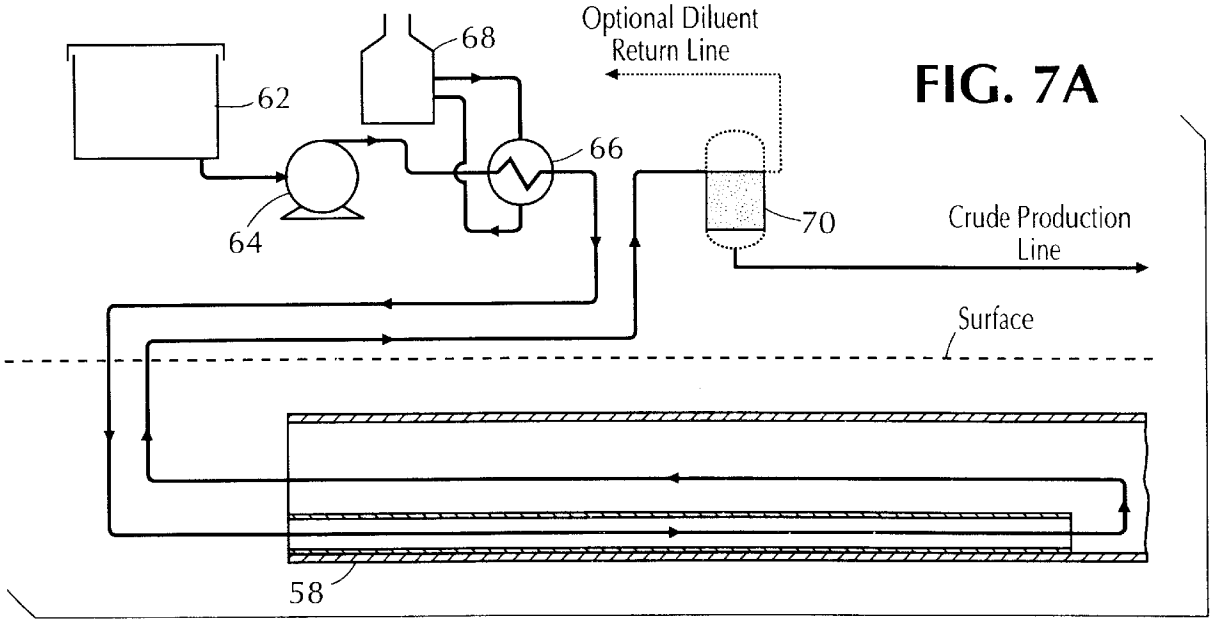
FIG. 7*a* is a schematic of the present invention employing a heated annulus with diluent injection.

Referring to FIGS. 7*a*–9*c*, heated annulus 52 improves extractability of heavy viscous crude oils from the well bore. The heated annulus 52 with diluent injection of FIGS. 7*a*–7*c* is intended to reduce oil viscosity by API gravity reduction and temperature increase. Oil viscosity is in direct inverse proportion to ease of extraction. Hence as viscosity increases difficulty in extraction increases. The heated annulus 52 with diluent injection is a unique device that allows introduction at well bore terminus 54 (TD-meaning "total depth") diluent and the induction of heat. The diluent is to be heated to its maximum permissible temperature without thermal decomposition and pumped to TD for injection in the production stream. An injection line 56 is placed within the well bore casing 58 at near full well bore length. Thermal transfer from the diluent heats the annulus that is positioned in the production stream within the well bore. Thermal transfer from the annulus 52 heats the production stream (crude oil mixed with diluent). The diluent, a kerosene or equivalent, is a high API gravity (light) hydrocarbon. When the diluent is mixed with the heavy (low API gravity) crude oil gravity increases and the production stream viscosity is reduced.

Figure 7B:
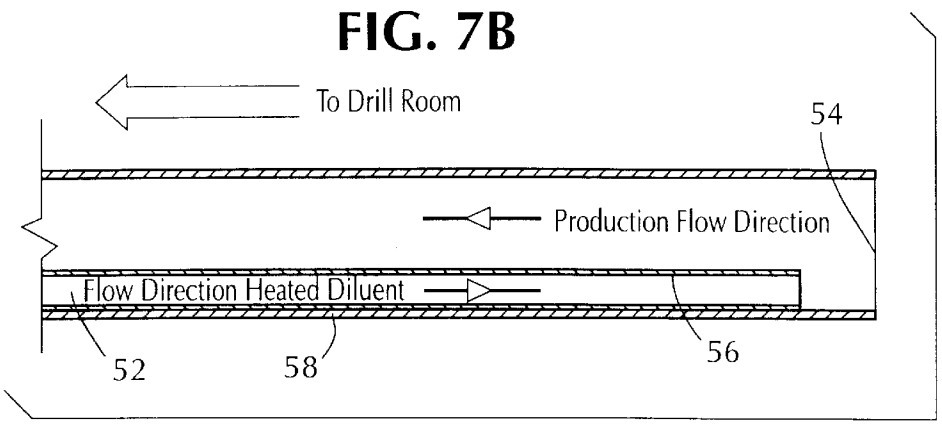
FIGS. 7*b* and 7*c* are detail views of FIG. 7*a;*
Figure 7C:
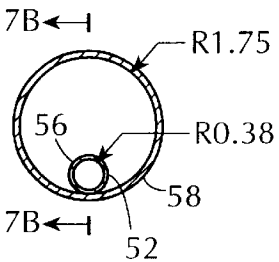
Figure 8A:
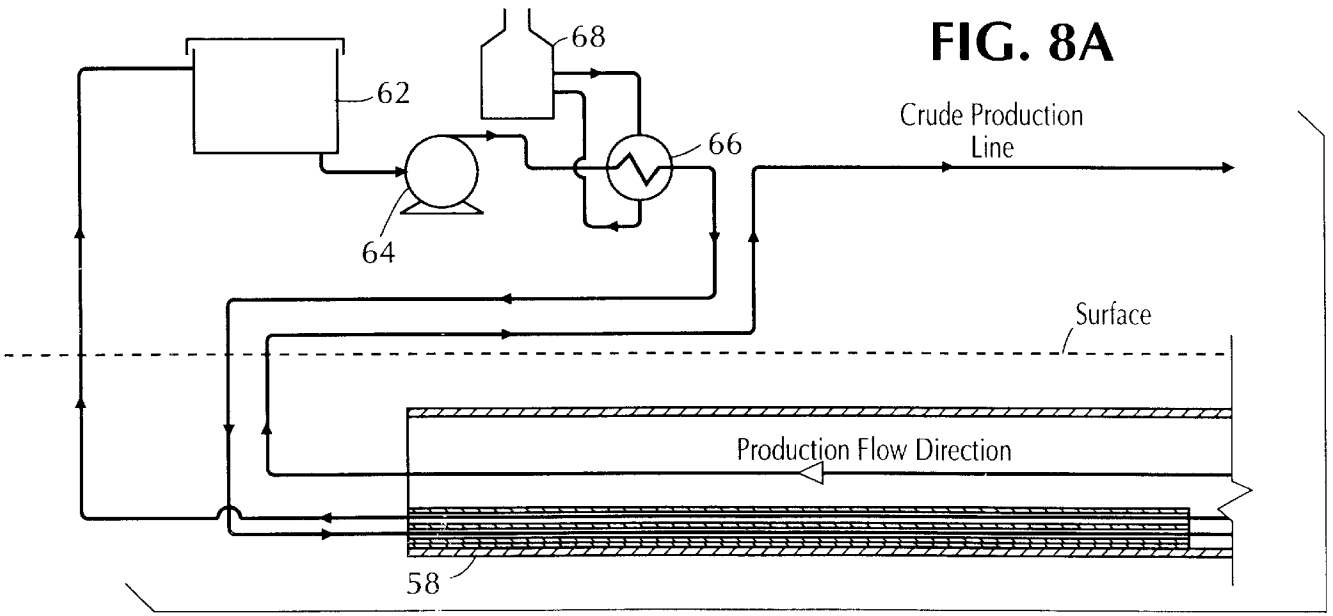
FIG. 8*a* is a schematic of the present invention employing a heated annulus with recirculation and reverse flow.
Figure 8B:
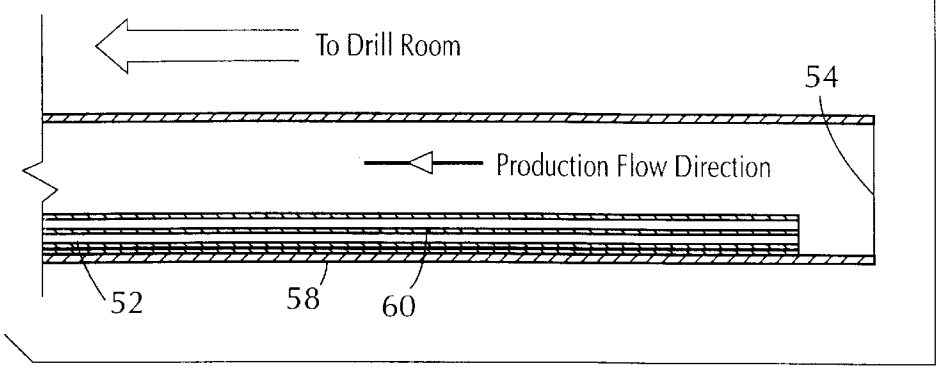
FIGS. 8*b* and 8*c* are detail views of FIG. 8*a;*
Figure 8C:
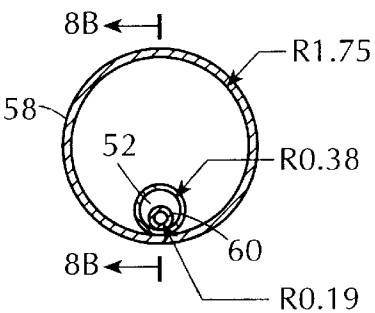
Figure 9A:
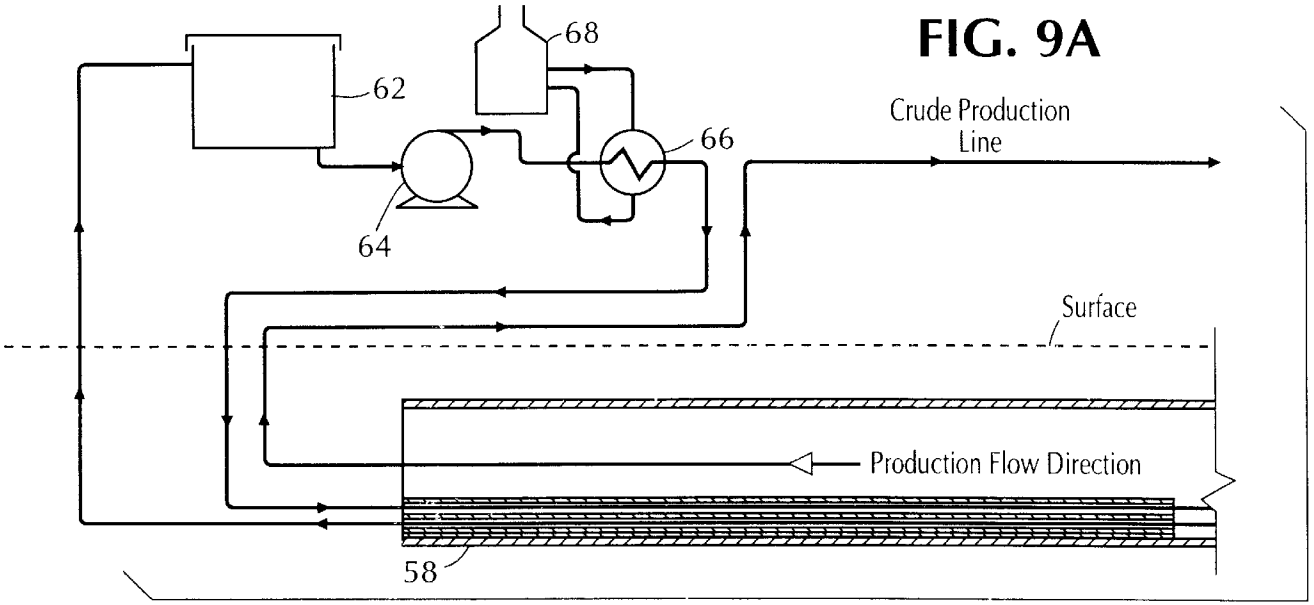
FIG. 9*a* is a schematic of the present invention employing a heated annulus with recirculation and normal flow.
Figure 9B:
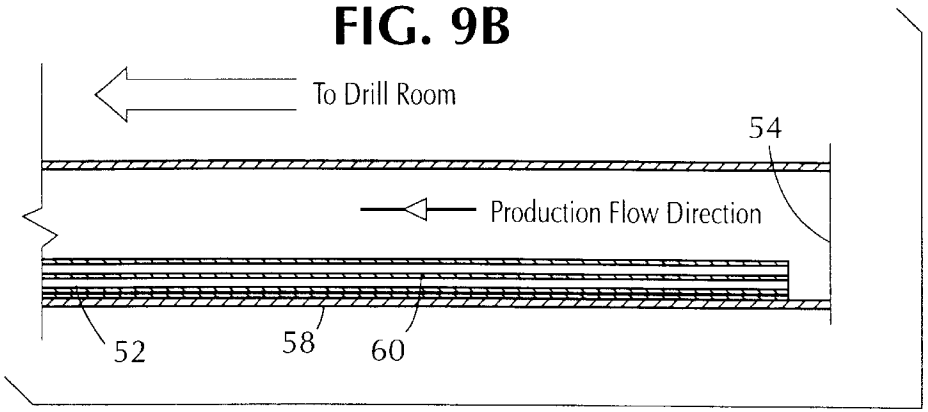
FIGS. 9*b* and 9*c* are detail views of FIG. 9*a;*
Figure 9C:
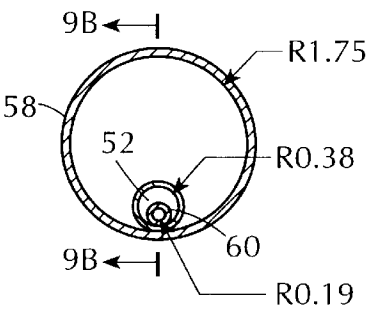

The heated annulus 52 without diluent injection (normal and reverse flow recirculation method) of FIGS. 8*a*–9*c* is likewise intended to improve extractability of heavy viscous crude oils from the well bore. The device with recirculation is intended to reduce oil viscosity by temperature increase. Oil viscosity is in direct inverse proportion to ease of extraction. Hence as viscosity increases difficulty in extraction increases. The heated annulus 52 with recirculated hot oil is a unique device that induces heat to the production stream. The annulus heating fluid is to be heated to its maximum permissible temperature without thermal decomposition and pumped to and recirculated from TD. Unlike the embodiment of FIGS. 7*a*–7*c*, the annulus 52 includes a concentric tubing 60 within the well bore casing 58 at or near full well bore length. Thermal transfer from the annulus heating fluid heats the annulus 52, which is positioned in the production stream within the well bore. Thermal transfer from the annulus 52 heats the production stream (crude oil). Also included in the three embodiments of FIGS. 7*a*–9*c* are diluent tank 62 connected to pump 64, and heat exchanger 66 connected to both pump 64 and boiler 68 with the fluid flow from heat exchanger 66 entering annulus 52. In FIGS. 7*a*–7*c*, flow entering annulus 52 passes there through into well casing 58 and then through stripping plant 70 and into the crude production line. In FIGS. 8*a*–8*c* and 9*a*–9*c*, flow entering annulus 52 also exits annulus 52 and returns to diluent tank 62.

Referring to FIG. 10, deployment lubricator 72 provides well control on a live well whilst allowing introduction of rigid drill tools into a subterranean well head. The tight radius of thrust-block 36 prohibits placement of rigid tools within the drill string 34 prior to induction in thrust-block 36. The lubricator 72 functions as a pressure lock that allows for introduction, connection to and servicing of rigid tools (bottom hole assembly) at the subterranean well head. The lubricator 72 accomplishes this by creating a chamber within the horizontal well section 76 adjacent to the blow-out-preventer (BOP) 74 that can be isolated from well bore pressure by the use of a globe valve 78. The lubricator 72 has a safety mechanism redundant to the BOP 74, a guillotine or shear 80, with sufficient force to sever any tool or device within the receiver 72 and permanently close the well. When the subterranean safety valve 78 is open the well functions as any ordinary section of the well bore and freely allows movement of drill tools and drill string 34. When the subterranean safety valve 78 is closed the lubricator 72 is isolated from well bore pressure; hence fluids and pressure within the lubricator 72 can be relieved through valves providing air venting and fluid drainage 82, 84, 86. When the lubricator 72 pressure is in equilibrium with atmospheric pressure the receiver 72 can be safely opened to the subterranean drill room allowing access to the rigid tools (bottom hole assembly).

Kill line 79 is a pump-in port that "kills" the well should a well control situation occur during drilling. Stuffing box 83 provides a dynamic and static pressure on drill string (coiled tubing) 34 while being deployed into or out of the well bore. Drill motor 85 causes rotational motion of drill bit 87, and orienter 89 ensures alignment of drill bit 87.

FIG. 11 shows the operation with one traction device (primary injector 100) being used at surface only and the thrust block 36 and BOP 74 stack being subterranean within the drill room. All tool deployment is done from within the drill room. Referring to FIG. 11, a curved raceway 48 of thrust block 36 provides a conduit for the string 34 in coiled tubing reel 100 to be deployed from surface to the drill room. The drill string 34 enters the drill room via a raceway extension and travels through the thrust block 36 set at the appropriate angle to enter the well bore. The bottom hole assembly is deployed within the drill room at the service window and connected to the coiled tubing string 34. The tools and the string are then run in whole through the blow out preventers 74 into the well. Fluid circulation is pumped by pump 101 through the coiled tubing string 34 from surface through the bottom hole assembly and returns are received into the drill room and pumped back to surface via a pump located within the drill room. All returns are then transported to surface where the cuttings are removed and the fluid can be reused or disposed. All forces snubbing or pulling during this operation are transmitted via the injector at surface where the cuttings are removed and the fluid can be re-used or disposed. All forces snubbing or pulling during this operation are transmitted via the injector at surface (primary injector 100). All tool deployment and safety barriers are within the drill room, which is subterranean.

Referring to FIG. 12, the description of elements common to both FIGS. 11 and 12 and previously described with reference to FIG. 11 is incorporated herein. Unlike the embodiment of FIG. 11, secondary injector 111 is present in addition to primary injector 100 in the laity embodiment of FIG. 12. Also, service window 98 is present. Service window 98 is a device for the containment and support of the primary injector 100. The purpose of the service window 98 is to isolate the primary injector device 100 from the return drill fluid stream and to pack-off fluid pressure and drain fluids from the primary injector device 100. This allows access and servicing of the primary injector 100 in atmospheric condition without withdrawal of the drill string 34. (Cessation of drilling operations is required during servicing.) During drilling operations the service window 98 isolates the primary injector 100 from the drill fluid return stream by diverting the drill stream return through a valved flow cross 102. Solids are retained or reintroduced to suspension prior to entry in the by-pass by use of a venturi that increases fluid velocity.

Referring to FIGS. 13*a* and 13*b*, gooseneck 121 supports drill string 34 between coiled tubing unit 110 and primary injector 100. Coiled tubing raceway 108 allows the remote introduction of coiled drill string 34 to a subterranean well head from a surface mounted coiled tubing unit 110. The raceway 108 provides directional stability for the coiled drill string 34 as snubbing (compressive) force is introduced to the drill string 34 to force the drill string 34 through the subterranean thrust block 36 and to provide drill bit force, if and when drill bit force is required. Due to its flexible nature coiled drill string 34 takes on a sinusoidal shape resulting in a helical form when compressed between the snubbing force and resistance which can be defined as further bending, drill pressure, drag and the like. The raceway 108 provides lateral support and alignment thereby minimizing transverse compression relief to the snub force required to induce the drill string 34 through the thrust-block 36 and provide drill bit force. Alignment of the drill string 34 within the raceway 108 is accomplished by the use of rollers 112 and or collars or bushings coated and or constructed with friction reducing materials such as nylon and teflon.

Referring to FIG. 13*b*, first drill mud line 123 is a drilling fluid return line. Gas vent line 125 is a conduit from the production room to allow gas to be transported to surface facilities. Second drill mud line 127 alleviates friction pressures that would be present if only first drill mud line 123 was employed. Production line 129 is a conduit from the production room to allow the produced fluids to be transported to the surface facilities. Power conduit 131 protects the main power cable between the production room and surface. Kill line 133 is a port through which the well can be "killed" should a well control situation occur during drilling. Communication conduit 135 houses all telemetry, control and telephone cabling between the surface and the drill room/production room facilities. Water line 137 allows water to flow from the surface to the drill room/production room. Compressed air line 139 sends air from the surface to the drill room/production room facilities.

Referring to FIG. 14, primary injector 100 applies force to the drill bit from a location below surface and remote from the coiled tubing unit 110. The primary injector 100 is intended to be synchronized to the secondary injector 101 located at the surface in immediate proximity to the coiled tubing reel of unit 110. The primary injector 100 will provide tension on the drill string 34 (coiled tubing) as it is extracted from the subsurface thrust-block 36 and compression on the drill string 34 between the drill bit and the traction device. Primary injector 100 has a center bore 116 through which drill string or coiled tubing 34 passes. A hydraulic motor 118 actuates gripper blocks 120, which contact drill string 34 in center bore 116, by means of chain 122 and skate ram 124. At one end of primary injector 100, stripper 126, cutters 128 having blind rams 130, and slips 132 having pipe rams 134 are arrayed. The primary injector 100 provides the advantage of shortening the distance between the force upon the drill bit and the drill bit when compared to surface level injection. This condition is advantageous due to the physical properties of drill string 34 and its inherent propensity towards elasticity. The tubing assumes a sinusoidal shape when sufficiently compressed between the snubbing force and resistance. The force at which sinusoidal geometry takes place reduces as distance between the snubbing force and resistance increases. Hence relocation of the force from the surface to the subsurface increases the distance at which horizontal borehole can be drilled utilizing coiled tubing. The placement of the primary injector 100 "down-hole" from the transition moment from vertical to horizontal also eliminates the bending resistance between the drill bit and the traction device. Likewise the total horizontal distance that can be drilled utilizing coiled tubing is increased. The primary injector 100 is operable as follows:

1. Horizontal operation
2. Operation below surface and remote from the coiled tubing source
3. Operation in synchronization with an above ground unit
4. Operation for the purpose of pulling (tension) the coiled tubing from vertical to horizontal or near horizontal alignment.

What is claimed is:

1. A sub-surface hydrocarbon production recovery arrangement for recovering hydrocarbons from below a surface, comprising:

a coiled drill string;

an apparatus for uncoiling said coiled drill string for passage through a substantially vertical shaft extending from the surface; and an apparatus for re-orienting said drill string from a substantially vertical to a substantially horizontal orientation below the surface such that said drill string can intersect the side or bottom of a subterranean hydrocarbon deposit, said apparatus for re-orienting said drill string including a thrust block having an arcuate portion by which orientation of said drill string is altered.

2. The subsurface hydrocarbon production recovery arrangement of claim 1 further comprising a rotatable turntable attached to said thrust block for alteration of the orientation of said drill string by a predetermined amount.

3. The subsurface hydrocarbon production recovery arrangement of claim 1 further comprising a deployment lubricator, said deployment lubricator creating a chamber isolatable from well bore pressure to allow introduction, connection and servicing of tools at a subterranean well head.

4. The sub-surface hydrocarbon production recovery arrangement of claim 1, wherein the apparatus for un-coiling said coiled drill string comprises an injector.

5. The sub-surface hydrocarbon production recovery arrangement of claim 4, further comprising an apparatus that isolates the injector from a return drill fluid stream.

6. The sub-surface hydrocarbon production recovery arrangement of claim 1, wherein the arcuate portion of the thrust block includes a raceway, the raceway being comprised of friction reduction devices.

7. The sub-surface hydrocarbon production recovery arrangement of claim 6, wherein the friction reduction devices are selected from a group consisting of rollers, bushings, and collars.

8. The sub-surface hydrocarbon production recovery arrangement of claim 6, wherein the friction reduction devices include a friction reduction material.

9. A method for recovering hydrocarbons from below a surface, comprising:

deploying a substantially vertical shaft extending from the surface;

uncoiling and passing a drill string through the substantially vertical shaft extending from the surface; and re-orienting said drill string from a substantially vertical to a substantially horizontal orientation below the surface such that said drill string can intersect the side or bottom of a subterranean hydrocarbon deposit, wherein said re-orientation of said drill string is accomplished by a thrust block having an arcuate portion by which orientation of said drill string is altered.

10. A sub-surface hydrocarbon production recovery arrangement for recovering hydrocarbons from below a surface, comprising:

a coilable drill string extending substantially horizontally below the surface in a subterranean room such that said drill string can intersect the side or bottom of a subterranean hydrocarbon deposit; and a first injector located in the subterranean room, wherein the first injector causes the deployment and advancement of the drill string toward the deposit.

11. The sub-surface hydrocarbon production recovery arrangement of claim 10, further comprising a deployment lubricator, the deployment lubricator creating a chamber isolatable from well bore pressure to allow introduction, connection, and servicing of tools at a subterranean well head.

12. The sub-surface hydrocarbon production recovery arrangement of claim 10, further comprising a well bore casing for passage of recovered hydrocarbons.

13. The sub-surface hydrocarbon production recovery arrangement of claim 12, further comprising a fluid conduit disposed within the well bore casing, the fluid conduit in fluid communication with a source of heated fluid for passage of the heated fluid through the fluid conduit.

14. The sub-surface hydrocarbon production recovery arrangement of claim 13, wherein the fluid conduit is in fluid communication with the well bore casing.

15. The sub-surface hydrocarbon production recovery arrangement of claim 14, wherein the heated fluid is a heated diluent.

16. The sub-surface hydrocarbon production recovery arrangement of claim 15, wherein the heated diluent intermixes with the recovered hydrocarbons, thereby effecting the viscosity of the mixed fluid of diluent and recovered hydrocarbon.

17. The sub-surface hydrocarbon production recovery arrangement of claim 13, wherein the heated fluid passing through the fluid conduit is isolated from the passage of the recovered hydrocarbons through the well casing.

18. The sub-surface hydrocarbon production recovery arrangement of claim 10, wherein the drill string is stored in a coiled state and located above the surface.

19. The sub-surface hydrocarbon production recovery arrangement of claim 18, wherein the drill string is deployed along a substantially vertical shaft extending from the surface.

20. The sub-surface hydrocarbon production recovery arrangement of claim 19, further comprising an apparatus for re-orienting the drill string from the substantially vertical to a substantially horizontal orientation below the surface.

21. The sub-surface hydrocarbon production recovery arrangement of claim 19, further comprising a second injector located above the surface, wherein the second injector receives the drill string from its coiled state and advances the drill string along the substantially vertical shaft.

22. The sub-surface hydrocarbon production recovery arrangement of claim 21, wherein the first injector is a primary injector and the second injector is the secondary injector.

23. The sub-surface hydrocarbon production recovery arrangement of claim 19, further comprising a support apparatus located above the surface, wherein the support apparatus receives the drill string from its coiled state and guides the drill string for introduction into the substantially vertical shaft.

* * * * *